United States Patent [19]

Richman

[11] Patent Number: 4,605,231

[45] Date of Patent: Aug. 12, 1986

[54] LIGHT TRANSMISSION PUZZLE GAME

[76] Inventor: Lawrence D. Richman, 7167 Lake Worth Rd., Lake Worth, Fla. 33463

[21] Appl. No.: 652,089

[22] Filed: Sep. 19, 1984

[51] Int. Cl.[4] ..... A63F 9/08

[52] U.S. Cl. ..... 273/157 A; 273/155

[58] Field of Search ..... 273/157 A, 155

[56] References Cited

U.S. PATENT DOCUMENTS

| | | | |
|---|---|---|---|
| 3,606,335 | 9/1971 | Reiner et al. | 273/157 A X |
| 3,649,024 | 3/1972 | Katzman | 273/157 A X |
| 3,655,201 | 4/1972 | Nichols | 273/153 S X |
| 3,778,063 | 12/1973 | Strand | 273/157 A X |
| 4,040,630 | 8/1977 | Brattain | 273/157 R |
| 4,402,510 | 9/1983 | Yokoi | 273/157 A X |
| 4,430,824 | 2/1984 | Yamamoto | 273/157 A X |
| 4,491,326 | 1/1985 | Halsey | 273/157 A |

FOREIGN PATENT DOCUMENTS

| | | | |
|---|---|---|---|
| 82/03563 | 10/1982 | World Int. Prop. O. | 273/155 |
| 621701 | 4/1949 | United Kingdom | 273/157 A |

OTHER PUBLICATIONS

Embree Manuf. Co. Brochure, 1 page.

*Primary Examiner*—Anton O. Oechsle

*Attorney, Agent, or Firm*—Hopgood, Calimafde, Kalil, Blaustein & Judlowe

[57] ABSTRACT

A puzzle game having at least one solution comprising at least 2 superposable light permeable portions. These portions are disposed in such a way that at least one superposition of light permeable portions in individually light continuous disposition will provide one solution. Light permeable portions may be oriented by means of a holder. In some embodiments, light permeable portions are translucent, transparent, polarizing or fiber optic.

12 Claims, 9 Drawing Figures

LIGHT TRANSMISSION PUZZLE GAME

BACKGROUND OF THE INVENTION

Games and puzzles have been a fixture of human society since the dawn of history. Among the longest lived of games are those that are both challenging and educating. Chess and go are in the first rank of such games.

It is an object of this invention to provide a game both enjoyable and stimulating.

It is another object of this invention to supply a game that teaches aspects of the nature of light, as found in color, polarity, optics and transmission.

SUMMARY OF THE INVENTION

In accordance with the foregoing objects and other objects that will become apparent to one of ordinary skill after reading the following specification, the present invention provides a puzzle game having at least one solution comprising at least two superposable light permeable portions. At least one superposition of light permeable portions in a light continuous disposition provides one solution of the puzzle game. In some embodiments light permeable portions may be borne by an assembly. When an assembly is present light permeable portions are disposed in their respective assemblies in such a way that at least one superposition of assemblies will orient the light permeable portions in an individually light continuous disposition providing one solution. By "individually light continuous disposition" is meant that position as to any single light permeable portion (or assembly) which will permit light to pass through its light permeable portions. This recognizes that the ultimate solution of a particular puzzle game arrived at by the superposition of combinations of light permeable portions or assemblies may be a solution that blocks out the passage of light through the totality of light permeable portions or assemblies.

BRIEF DESCRIPTION OF THE DRAWINGS

A better understanding of the present invention can be derived from reading this specification in conjunction with the accompanying drawings wherein.

DETAILED DESCRIPTION

Figure 1:
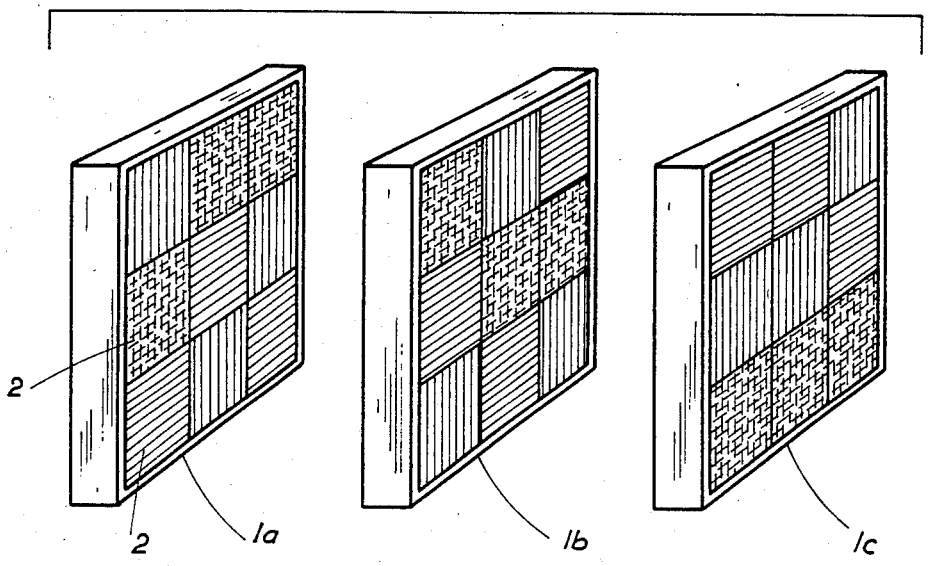
FIG. 1 is a side elevation of the puzzle game with 3 assemblies of 9 light permeable portions each.

Referring first to FIG. 1, the assemblies 1*a*, 1*b* and 1*c* are, in this embodiment, square frames. Within each square frame assembly are nine light permeable portions 2, indicated herein variously as red, yellow and blue. The square frame assemblies are shown as oriented in individually light continuous disposition. In the particular superposition shown light passing through the light permeable portions of the assemblies would blend together into a single color.

Figure 2:
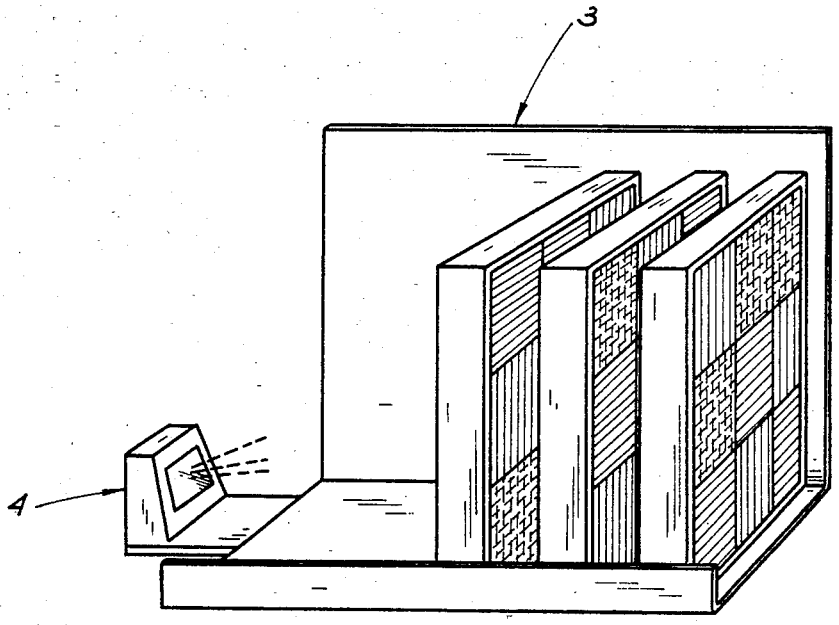
FIG. 2 is a side elevation of the assemblies of FIG. 1 supported by a holder means which has a light means.

FIG. 2 is a side elevation of the assemblies of FIG. 1 in a holder means 3, with the holder means superposingly holding the assemblies such that they will be in individually light continuous disposition to each other and to a light means 4.

Figure 3:
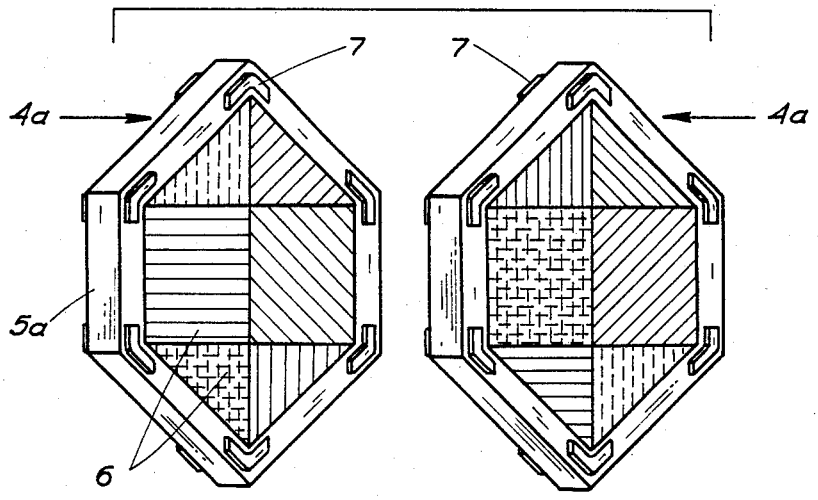
FIG. 3 is a side elevation view of two hexagonal superposable assemblies, each assembly bearing registrably engaging means.

FIG. 3 is a side elevation view of hexagonal assemblies 5*a* and 5*b* superposed and having triangular and square light permeable portions 6, and each assembly bearing registrably engaging means 7, capable of registrably engaging adjacent assemblies such that light permeable portions of one assembly will be registrably and engagably alined with light permeable portions of an adjacent assembly.

Figure 4:
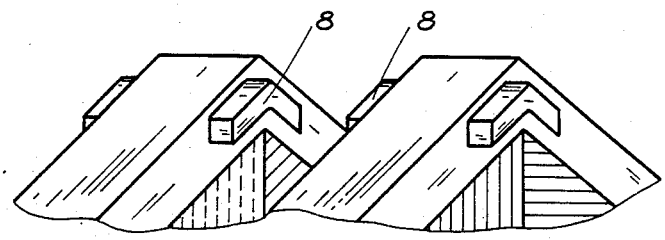
FIG. 4 is a detailed view of the assemblies of FIG. 3 showing, in exaggeration, registrably engaging means.

FIG. 4 is a detailed view taken at 4*a*–4*a* of FIG. 3 showing registrably engaging means 8, here being magnets.

Figure 5:
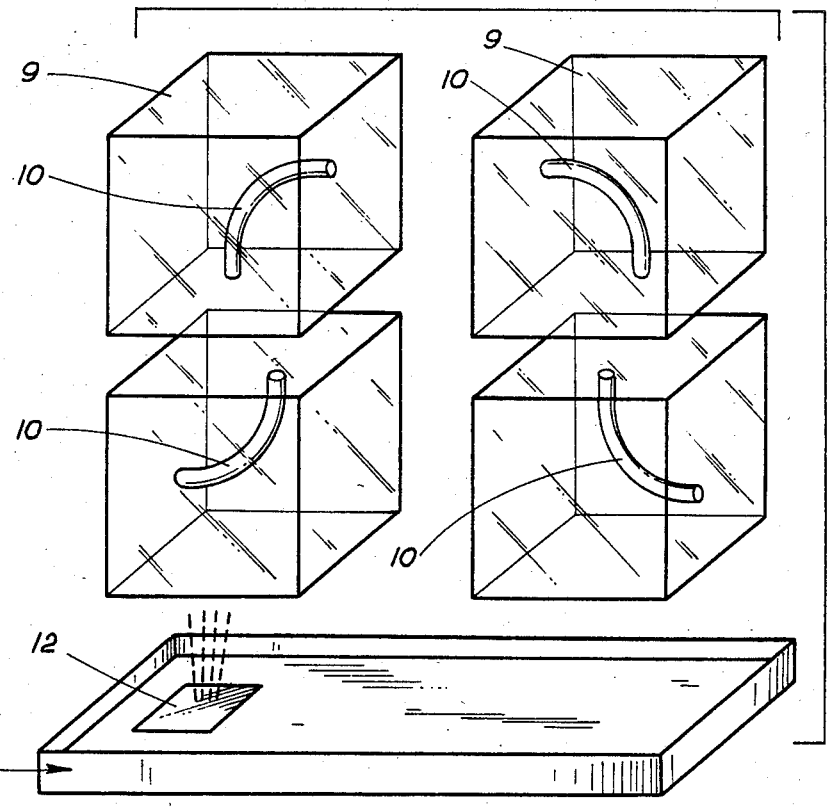
FIG. 5 is a side elevation of cube shaped assemblies drawn in phantom, and bearing fiber optic light permeable portions.

FIG. 5 is a side elevation of cube shaped assemblies 9, in phantom drawing with fiber optic light permeable portions 10 and holder means 11 for holding said cubes with light means 12 for illuminating light permeable portions.

Figure 6:
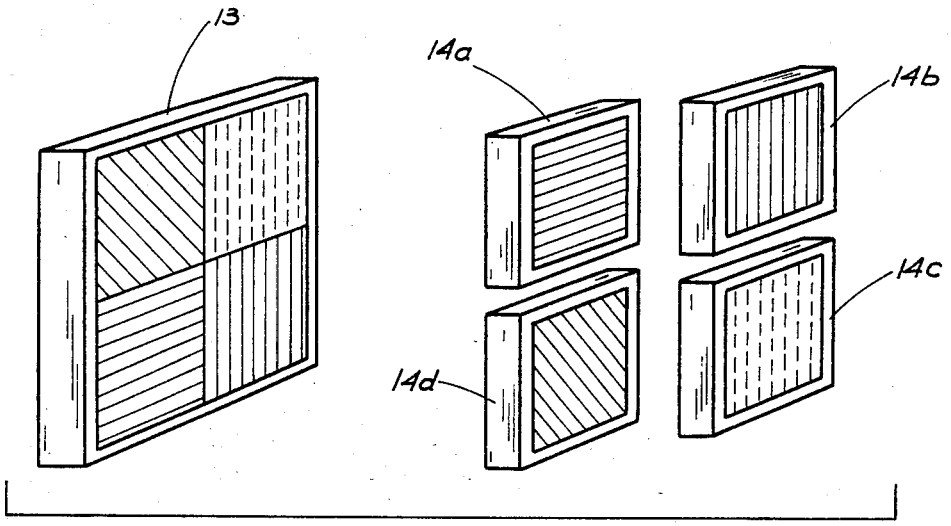
FIG. 6 is a side elevation of complementarily superposable assemblies.

FIG. 6 is a side elevation of complementary, superposable assemblies 14*a*, 14*b*, 14*c* and 14*d* each one-fourth quarter the size of assembly 13 shown as superposed with respect to assemblies 14.

Figure 7:
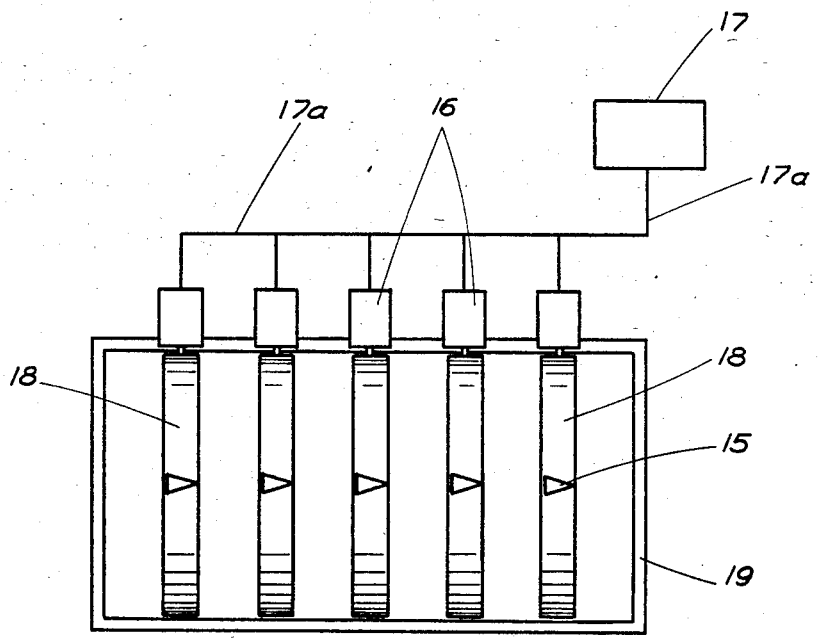
FIG. 7 is a plane view of circular assemblies in a holder means displaying a secondary assembly code, wherein the holder means has a light means, an assembly movement means and a movement control means.

FIG. 7 is a plane view of circular assemblies 18 in a holder means 19 displaying secondary solution means 15 on the assemblies, with each assembly selectably movably engaged by moving means 16 activated by a movement control means 17 to which it is linked by linking means 17A.

Figure 8:
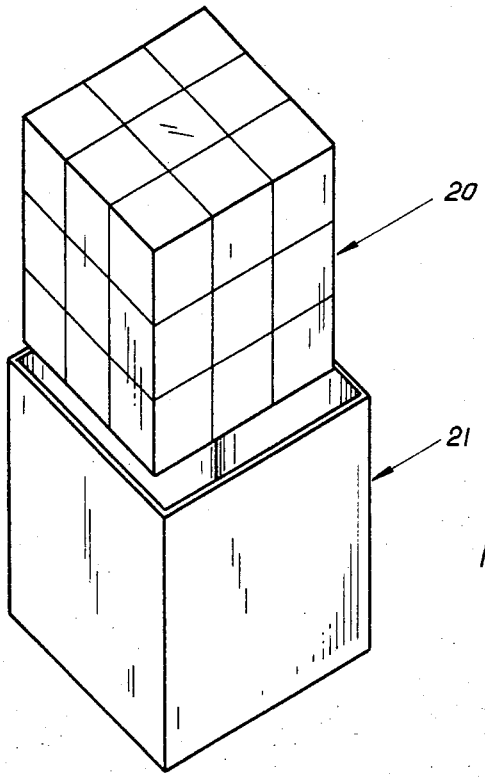
FIG. 8 is a side elevation of transparent colored cube shaped light permeable portions shown partially conformed in a holder means.

FIG. 8 is a side elevation of cubed shaped light permeable portions 20, here color transparent plastics shown as partially contained in a holder means 21, here a clear plastic holder of 5 sides. In this embodiment an assembly is not necessary. This embodiment may additionally be provided with a cover means (not shown) for the holder means, permitting inversion of the puzzle game holder means. The holder means may also be provided with partition means so that a particular rank or file of light permeable portions may be inserted or removed without disturbing others.

In one embodiment of FIG. 8 a solution may comprise the superposition of all light permeable portions will permit all surfaces of the assembled puzzle game to appear the same color no matter which surface the game is viewed from.

Figure 9:
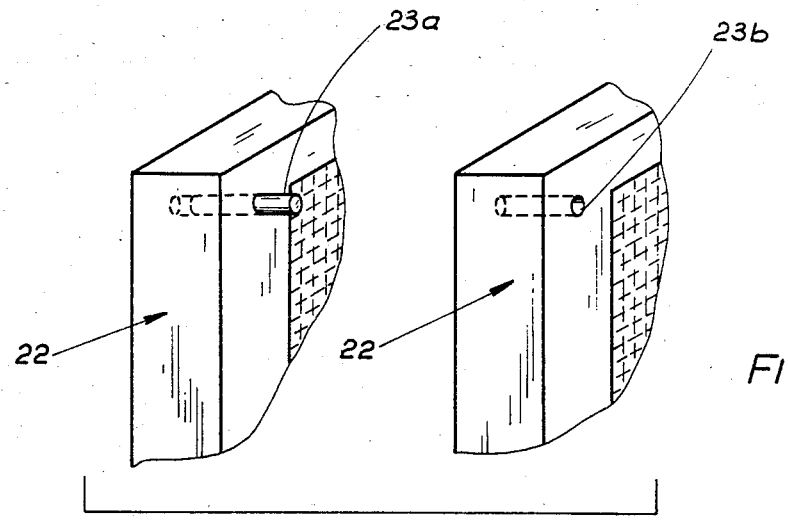
FIG. 9 is a detailed view of disposable light permeable portions, showing, in exaggeration, an engaging means for registrably engaging light permeable portions.

FIG. 9 is a detailed view of two light permeable portions 22 showing an engaging means 23, a pin for registrably engaging one light permeable portion in individually light continuous disposition with a second superposable light permeable portion engaging means 23*b*, here a socket.

The secondary solution means 15 shown here is comprised of elements in the form of marks which, when alined, cause the light permeable portions to be alined to display a solution.

It is clear from the foregoing that any number of variables can be added or selected to increase the challenge and enjoyability of the puzzle game. In some embodiments assemblies may have removable or replaceable light permeable elements.

The size and shape of the assemblies and light permeable portions may be varied. In addition to the assembly shapes shown, triangles, octagons or other geometric assemblies which will be generally flat may be selected. However, any generally superposable shapes may be used. Cubes have been shown. Assemblies that may be described as shaped, flat surfaces such as hemispheres or pyramids or other stackable shapes may also be devised. Fully three dimensional shapes including above noted cubes and also including tetrahedrons or other shapes may be employed.

The light permeable portions can be selected from transparent materials, translucent materials (each being either colored or colorless), polarizing materials, pattern grid materials (which in combination may produce moire patterns), liquid crystal materials, materials of variegated colors, holographic materials, fiber optic materials, light refracting materials or any combination thereof. In a particular assembly of multiple light permeable portions certain portions of such an assembly may be opaque.

A given secondary solution means may be as simple as the marks of FIG. 7 or in other embodiments comprised of segments of a large picture or puzzle or mathematical relationship, the solution of the secondary solution element coinciding with a visual solution of the light permeable portions. These solution means may be part of the assemblies or on the light permeable portions.

Changing the nature of the light passing through the light permeable portions may be used to change the nature of a solution. Light such as laser light, polarized light or colored light will accomplish this. A light means is utilized to permit the player to more easily observe the color effect of various superpositions of assemblies.

A particular embodiment of the puzzle game might have multiple solutions such as a particular portion of all superposed assemblies being a particular color, a particular letter or particular shape.

In the preferred embodiment, 3 square assemblies of 9 equal, square light permeable portions, each are prepared as shown in FIG. 1. This yields 512 superpositions of assemblies one of which will make the entire presenting surface of superposed assemblies of uniform dark color.

After reading the foregoing, one of ordinary skill in the art will be able to effect various changes, substitutions of equivalents and other alterations without departing from the spirit of the invention and general concepts disclosed. For example, the puzzle game can be designed to teach the results of various color combinations or used for encryption techniques. The invention will be limited only by the claims.

What is claimed is:

1. A puzzle game having at least one solution comprising at least 2 multicolored superposable light permeable portions, said portions selected from the group consisting of colored and uncolored transparent elements and colored and uncolored translucent elements disposed in such a way that at least one superposition of light permeable portions, each in individually light continuous disposition will define one solution in which the surface appearance of the puzzle is of the same color and wherein each said light permeable portion further comprises an engaging means suitable for registrably engaging at least one other superposable light permeable portion.

2. The puzzle game of claim 1 additionally comprising a holder means suitable for registrably engaging at least 2 superposable light permeable portions in individually light continuous disposition.

3. The puzzle game of claim 2 wherein said holder means additionally includes light means disposed, relative to said light permeable portions, in linear relation to that position comprising individually light continuous disposition.

4. The puzzle game of claim 1 wherein the superposable light permeable portions additionally comprise a secondary solution means, said solution means comprising secondary solution elements disposed on the light permeable portions.

5. A puzzle game having at least one solution comprising at least two multicolored superposable assemblies, each assembly comprising at least one light permeable portion selected from the group consisting of colored and uncolored transparent elements and colored and uncolored translucent elements, said portion being disposed in an assembly in such a way that at least one superposition of assemblies will orient the light permeable portions, each in individually light continuous disposition to define one solution in which the surface appearance of the puzzle is of the same color and wherein each said superposable assembly further comprises an engaging means suitable for registrably engaging at least one other superposable assembly.

6. The puzzle game of claim 5 additionally comprising a holder means suitable for registrably engaging at least 2 superposable assemblies in individually light continuous disposition.

7. The puzzle game of claim 6 wherein said holder means additionally includes a light means disposed, relative to said light permeable portions, in linear relation to that position comprising individually light continuous disposition.

8. The puzzle game of claim 5 wherein the superposable assemblies additionally comprise a secondary solution means, said solution means comprising secondary solution elements disposed on the assemblies at positions other than light permeable portions.

9. The puzzle game of claim 5 or 2 superposable assemblies a first, second and third assembly, each assembly of 9 light permeable portions wherein the first assembly comprises light permeable portions of red in the top left, yellow top center and yellow top right, yellow in the middle left, blue middle center and red middle right, and blue in the lower left, red lower center and blue lower right, and the secondary assembly comprises yellow in the top left, red top center, and blue top right, and blue in the middle left, yellow middle center, and yellow middle right, and red in the lower left, blue lower center, and red lower right, and a third assembly comprises blue in the top left, blue top center and red top right, red in the middle left, red middle center and blue middle right, and yellow in the lower left, center and right.

10. The puzzle game of claim 9 wherein the superposable assemblies further comprise an engaging means suitable for registrably engaging the assemblies.

11. The puzzle game of claim 9 additionally comprising a holder means suitable for registrably engaging said assemblies in individually light continuous disposition.

12. The puzzle game of claim 11 wherein said holder means further includes light means disposed relative to said light permeably portions in linear relation to that position comprising individually light continuous disposition.

* * * * *

UNITED STATES PATENT AND TRADEMARK OFFICE

CERTIFICATE OF CORRECTION

PATENT NO. : 4,605,231

DATED : August 12, 1986

INVENTOR(S) : Lawrence D. Richman

It is certified that error appears in the above—identified patent and that said Letters Patent is hereby corrected as shown below:

Claim 9, line 1 delete "or 2" and insert therefor

-- of 3 --

Signed and Sealed this

Fourth Day of November, 1986

[SEAL]

*Attest:*

DONALD J. QUIGG

*Attesting Officer*

*Commissioner of Patents and Trademarks*